US010161067B2

(12) United States Patent
Bischoff et al.

(10) Patent No.: US 10,161,067 B2
(45) Date of Patent: Dec. 25, 2018

(54) FABRIC FOR USE IN COMPOSITE MATERIALS AND METHOD FOR PRODUCING SAID FABRIC AND A COMPOSITE MATERIAL BODY

(75) Inventors: Thomas Bischoff, Buxtehude (DE); Melike Afsar, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 790 days.

(21) Appl. No.: 14/381,166

(22) PCT Filed: Mar. 1, 2012

(86) PCT No.: PCT/EP2012/053569

§ 371 (c)(1),
(2), (4) Date: Jan. 12, 2015

(87) PCT Pub. No.: WO2013/127460

PCT Pub. Date: Sep. 6, 2013

(65) Prior Publication Data

US 2015/0126089 A1 May 7, 2015

(51) Int. Cl.
*D03D 13/00* (2006.01)
*D03D 1/00* (2006.01)
(Continued)

(52) U.S. Cl.
CPC ..... *D03D 1/00* (2013.01); *D03D 13/00* (2013.01); *D03D 13/006* (2013.01); *D03D 15/0088* (2013.01); *D03D 15/0094* (2013.01); *D03D 19/00* (2013.01); *D03D 25/005* (2013.01); *D04H 3/002* (2013.01); *D04H 3/04* (2013.01);
(Continued)

(58) Field of Classification Search
CPC .. D03D 13/006; D03D 13/00; D03D 15/0088; D03D 15/0094; D03D 19/00; D03D 25/005; D03D 2700/0196; Y10T 442/3179
See application file for complete search history.

(56) References Cited

U.S. PATENT DOCUMENTS 4,320,160 A * 3/1982 Nishimura ..... B29C 70/202 428/298.1
4,469,739 A * 9/1984 Gretzinger ..... D03D 15/00 442/200
(Continued)

*Primary Examiner* — Jeremy R Pierce
(74) *Attorney, Agent, or Firm* — Leydig, Voit & Mayer, Ltd.

(57) ABSTRACT

A fabric (10) for use in composite materials having a reinforcing system (11) made of reinforcing warp threads (13) and reinforcing weft threads (14), which are placed on top of one other in two different reinforcing layers (16), (17). A binding system (12) of binding warp threads (20) and binding weft threads (21) is formed from a binding yarn (30) with a lower yarn count than the reinforcing yarn (15). The reinforcing system (11) is enclosed between the binding warp threads (20) on the one side and the binding weft threads (21) on the other side, and thus, held in place at binding points (22). At each binding point (22), a binding warp thread (20) is guided and held between a stationary warp thread (25) and a regular warp thread (24) of a warp thread pair (23) of binding warp threads (20). Between two adjacent binding points of a warp thread pair (23), the stationary warp thread (25) and the regular warp thread (24) have intersecting points (26).

15 Claims, 5 Drawing Sheets

(51) Int. Cl.

| | |
|---|---|
| ***D04H 3/04*** | (2012.01) |
| ***D03D 15/00*** | (2006.01) |
| ***D03D 19/00*** | (2006.01) |
| ***D04H 3/002*** | (2012.01) |
| ***D03D 25/00*** | (2006.01) |
| ***D06C 7/00*** | (2006.01) |

(52) U.S. Cl.
CPC ..... *D06C 7/00* (2013.01); *D10B 2403/02411* (2013.01); *D10B 2403/02412* (2013.01); *D10B 2505/02* (2013.01); *Y10T 442/3179* (2015.04)

(56) References Cited

U.S. PATENT DOCUMENTS 5,085,253 A * 2/1992 Motta ..... D03C 7/06 139/419
5,484,642 A * 1/1996 Bompard ..... B29C 70/22 442/195
5,752,550 A * 5/1998 Scari' ..... D03D 15/0011 442/189
2002/0164911 A1* 11/2002 Cunningham ..... F41H 5/0485 442/135
2005/0059307 A1* 3/2005 Moeseke ..... A41D 31/0061 442/134
2006/0169347 A1* 8/2006 Wahhoud ..... D03C 7/06 139/383 R
2010/0132825 A1* 6/2010 Fujisawa ..... D21F 1/0036 139/413

* cited by examiner

FABRIC FOR USE IN COMPOSITE MATERIALS AND METHOD FOR PRODUCING SAID FABRIC AND A COMPOSITE MATERIAL BODY

FIELD OF THE INVENTION

The invention relates to a fabric that is provided and designed for the production of composite materials, also referred to as composites, and more particularly to fabric-reinforced composite materials.

BACKGROUND OF THE INVENTION

In conventional fabrics, thread convolutions are formed by binding warp threads and weft threads, said convolutions causing a non-ideally elongated alignment of the threads when used in composite materials. Reinforcing threads used for reinforcing the composite material are therefore kinked or convoluted. This is a problem in so far as the reinforcing threads display their optimal strength properties and/or stiffness properties only if they are arranged as elongated as possible and convolutions and kinks having small radii are avoided, such radii occurring in conventional fabrics between the warp and weft threads in the region of the binding points. It is possible to minimize convolutions of reinforcing threads in conjunction with this in cases when greater distances are provided between the binding points, i.e., when larger floats are planned. This also increases the drapability of the fabric when it needs to be adapted to the three-dimensional shape of the composite material body. However, with larger floats, undesirable shifts of the reinforcing threads may occur so that, when draping the fabric to shape the composite material body, sites of inadequate reinforcement may form and/or the thread density at other sites may be too high.

Frequently, difficulties may also arise when the conventional fabrics are used in so-called preforms during production. One or several fabric layers are superimposed in such preforms in order to later—during a subsequent process step—produce the desired composite material body in a component form. Inasmuch as the dwell time of the component form should be kept as short as possible, one or more preforms are frequently made before the final production of the composite material body, which preforms may then be combined in the component form to produce a composite material body within a shorter period of time. The preform is preformed in a manner such that, when the preform is placed in the component form, only smaller and less time-consuming customization operations are required. Consequently, it is necessary that the fabric of the preform can be brought into a three-dimensional shape that subsequently must be customizable at least in some areas. To accomplish this, binders have been used until now, these being sprays, powders of fleece layers that are laminated or sprayed onto the fabric in order to ensure the dimensional stability of the preform and, at the same time, maintain the drapability of the fabric for continued processing. However, frequently this cannot be accomplished in a reproducible manner, and either the dimensional stability of the preform suffers or the drapability of the preform during continued processing to produce the composite material body suffers.

A fabric for composite material bodies is known from publication U.S. Pat. No. 4,320,160. This fabric comprises a reinforcing system of reinforcing threads and binding threads that are disposed for binding the reinforcing system. As binding threads, either the binding warp threads are interlaced with the binding weft threads by simple binding, or the binding warp threads are interlaced with the reinforcing warp threads or with the reinforcing weft threads of the reinforcing system.

The fabric known from publication U.S. Pat. No. 4,320,160 has the disadvantage that, due to the suggested binding systems, the thread tension of the binding threads affects an undesirable convolution of the reinforcing threads of the reinforcing system. This means that the thread convolution of the reinforcing threads can be prevented only if the thread tension of the binding threads is low. However, the result of this is that it is not possible to ensure sufficient displacement resistance of the reinforcing threads of the reinforcing system, which is of disadvantage when the fabric is to be draped at the time of manufacture of the composite material body. If the desired displacement resistance is to be achieved, the thread tension causes a convolution of the reinforcing threads on the one hand, and, on the other hand there is the risk that the reinforcing yarns are bundled due to the high thread tension of the binding thread between the binding points and that, as a result of this, an undesirable lattice structure with excessively large thread distances between the reinforcing threads is created.

Also, publication DE 20 2005 014 801 U1 discloses a fabric with a reinforcing system of reinforcing threads and binding threads for binding the reinforcing system. Also in this case the binding threads and the reinforcing threads are interlaced, thus bringing about the disadvantages described in conjunction with publication U.S. Pat. No. 4,320,160.

OBJECTS AND SUMMARY OF THE INVENTION

It is an object of the present invention to provide a fabric for the manufacture of composite materials or composite material bodies which enables good handleability when the fabric is shaped, and at the same time, ensures sufficient mechanical stability of the composite material or composite material body that is produced.

The fabric in accordance with the invention comprises a reinforcing system of reinforcing weft threads and reinforcing warp threads. The reinforcing warp threads form a first reinforcing layer that is placed on a second reinforcing layer, said second reinforcing layer consisting of reinforcing weft threads. Consequently, the reinforcing weft threads and the reinforcing warp threads are superimposed in a crosswise manner, without binding.

In addition, the fabric comprises a binding system of binding warp threads and binding weft threads. The binding warp threads and the binding weft threads are bound together at the binding points. There is no binding between the threads of the binding system and threads of the reinforcing system. The reinforcing system is located between the binding warp threads and the binding weft threads and is held and fixed in place only by the binding within the binding system. In doing so, the binding system is embodied as a leno system. The binding warp threads are configured either as stationary warp threads or as regular warp threads. They form several binding warp thread pairs, each consisting of a stationary warp thread and a regular warp thread that interact with binding weft threads in order to form the binding. The leno system may also be configured as a half-leno or full-leno system. The stationary warp thread and the regular warp thread of a warp thread pair intersect at or between the binding points. The respective binding weft thread is taken up and held at a binding point between the stationary warp thread and the regular warp thread. As a result of this, the binding weft thread is well fixed in place by the binding warp thread pair at each binding point. This guarantees sufficient displacement resistance of the threads of the binding system and, as a result, also of the threads of the reinforcing system. A high thread tension of the threads in the binding system is not necessary. In this manner, it is possible to avoid an undesirable convolution of the threads of the reinforcing system. This, in turn, results in excellent mechanical stability of the fabric because the reinforcing weft threads and the reinforcing warp threads may extend stretched in the respective reinforcing layer and only display curvatures and radii that are necessary due to the shape of the composite material body during its manufacture.

In a preferred exemplary embodiment, the binding warp threads extend adjacent the second reinforcing layer of reinforcing weft threads, and the binding weft threads extend adjacent the first reinforcing layer of reinforcing warp threads.

In another preferred embodiment, the at least one intersecting point between the stationary warp thread and the regular warp thread of a warp thread pair is provided directly at the binding point with the respective binding weft thread. Inasmuch as, at the binding point, the threads of the binding system extend between the threads of the reinforcing system, i.e., extend through the reinforcing layers, it is advantageous to use the resultant space that is necessary anyhow between the adjacent reinforcing warp threads or the adjacent reinforcing weft threads and to also provide there the at least one intersecting point of the stationary warp thread and the warp thread.

Preferably, the binding warp threads extend, relative to the reinforcing warp threads, without intersecting points. Accordingly, preferably the binding weft threads preferably do not intersect relative to the reinforcing weft threads. In other words, all the warp threads extend in one warp thread direction and all the weft threads extend in one weft thread direction, the latter being oriented at approximately a right angle relative to the warp thread direction. This allows a simple manufacture of the fabric on a weaving machine.

The number of intersecting points between the reinforcing weft threads and the reinforcing warp threads is equal to or greater than the number of binding points in the binding system. In other words, the number of binding weft threads is smaller than the number of reinforcing weft threads. Furthermore, the number of binding warp thread pairs may be at most as great as the number of reinforcing warp threads. The distance between the binding points in the binding system is preferably chosen large enough so that correspondingly large floats are formed in the binding system. The distance between the binding points in the binding system may vary within the fabric in longitudinal direction of the fabric and/or in transverse direction of the fabric, this being a function of the composite material to be produced and, in particular, the shape of the composite material body to be produced therefrom. If, at one point of the fabric, greater displacement resistance is desired, the float is smaller at that point, and hence the number of binding points is greater than at other points. Conversely, if the drapability of the fabric is to be increased at specific points, a greater float may be provided in the binding system.

For the reinforcing weft threads and for the reinforcing warp threads, in particular, a reinforcing yarn is selected that is different from the binding yarn that is used for the manufacture of the binding warp threads and the binding weft threads. It is mainly the reinforcing threads of the reinforcing system that are responsible for the mechanical stiffness or strength of the composite material. For example, the reinforcing yarn may contain carbon fibers and/or aramid fibers and/or glass fibers. In a preferred exemplary embodiment, the reinforcing yarn has a flat cross-section, wherein the dimension in a width direction is greater than the dimension transverse thereto in height direction. Different therefrom, the binding yarn has a cross-section that is, e.g., circular. The titer or the cross-section of the binding yarn is, in particular, smaller than the titer or the cross-section of the reinforcing yarn. In this manner, the mass percent of the binding yarn can be kept minimal compared to the reinforcing yarn in the fabric. Furthermore, the space requirement between two adjacent threads of the reinforcing system at the binding points for the binding threads of the binding system is minimal, so that the reinforcing threads can be arranged closely next to each other at a minimal distance. The titer of the binding yarn is preferably a maximum of 500 dtex.

In a preferred embodiment, a binding yarn is used, the material of which binds well and substantially completely with the plastic material of the composite material in the production of the composite material. The material selection of the binding yarn may be dependent on the plastic material that is used for the composite material. In particular, the binding yarn comprises a material having a melting temperature that is at most as high as the temperature that is reached during the production of the composite material or the composite material body, so that a hot-melt bond is attained, on the one hand, between the binding yarns and the reinforcing yarns and, on the other hand, between the plastic material and the composite material. For example, the mass percent of the binding yarn in the binding system can be prespecified in such a manner that the interlaminar shearing strength achieved with the reinforcing system deviates only by a maximum tolerance value of, for example, 5%. This can be of consequence whenever the binding yarn that is used cannot bond or bond only poorly with the plastic material of the binding material that is to be produced.

Binding yarns that can be taken into consideration are, for example, phenoxy yarns such as, e.g., Grilon MS® of EMS Chemie company. However, it is also possible to use other yarns, in particular hot-melt adhesive yarns such as, e.g., copolyester yarns.

Furthermore, it is advantageous if the binding yarn consists of a core and a coat enclosing the core, wherein the core and the coat preferably consist of different materials. In doing so, particularly the melting temperature of the coat is lower than that of the core. By means of such a binding yarn it is possible to achieve a hot-melt bond during the production of the composite material, wherein the core remains stable. Consequently, the core upholds the structure of the fabric, while the coat can be generated by means of a hot-melt adhesive bond.

The use of hot-melt adhesive yarns or yarns having a core and a coat exhibiting different melting temperatures in the binding system additionally allow a simple manufacture of preforms. The fabric can be stored in the desired form of the preform and, if necessary, be bonded to the threads of the reinforcing system or to additional fabric layers of the preform for the intermediate fixation in some areas by thermal action. In doing so, additional binding agents such as powder or spray may be omitted.

Such a fabric can be produced very simply with a method using a weaving machine. This is done in that the reinforcing weft threads and the binding weft threads are inserted or shot in consistent with a prespecified sequence. During a weft insertion with a reinforcing thread, all the reinforcing warp threads are always in the same shed, preferably, the upper shed. During a weft insertion with a binding weft thread, each of the regular warp threads is in the same shed, preferably the upper shed, while the stationary warp threads of the warp thread pair of the binding warp threads, as well as of the reinforcing warp threads, are in respectively the other shed, preferably the lower shed. Preferably, the regular warp thread and the stationary warp thread are directly intersected with the binding warp thread before and/or after the binding point. In this manner, the fabric is produced for the composite material as described hereinabove. During manufacture, the reinforcing warp threads are advantageously guided in a single weaving shaft. In doing so, the stationary warp threads and the regular warp threads are guided in different weaving shafts of the weaving machine.

Other objects and advantages of the invention will become apparent upon reading the following detailed description and upon reference to the drawings, in which:

Figure 1:
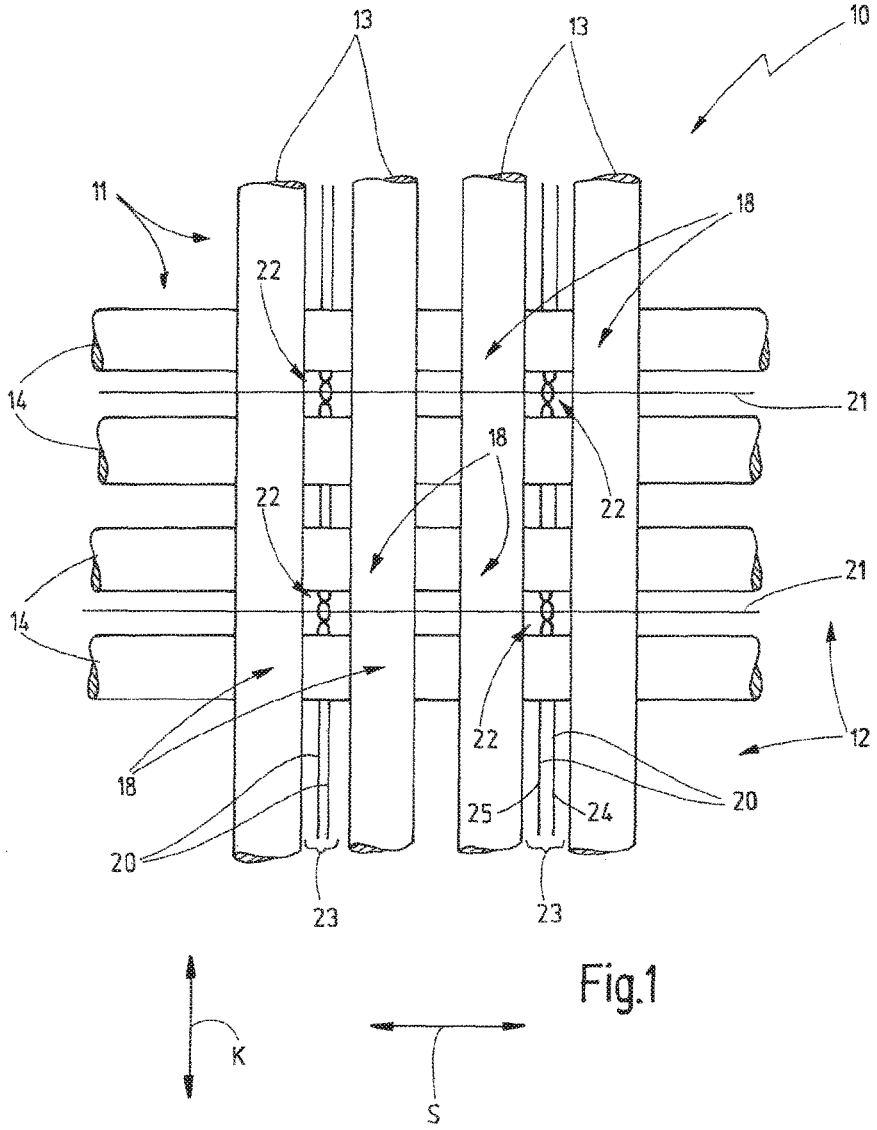
FIG. 1 is a schematic plan view of an illustrative fabric in accordance with the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Referring more particularly to FIG. 1 of the drawings, there is shown an illustrative fabric 10 in accordance with the invention for the production of composite materials or composite material bodies, in particular a composite of fabric 10 and plastic material. The fabric 10 comprises a reinforcing system 11, as well as a binding system 12. The reinforcing system 11 consisting of reinforcing warp threads 13 and reinforcing weft threads 14 is disposed to impart the composite material or the composite material body with the desired mechanical properties by interacting with another material, specifically plastic. In doing so, the reinforcing system 11 improves the strength and stiffness of the composite material. In the exemplary embodiment, the reinforcing warp threads 13 and the reinforcing weft threads 14 consist of a reinforcing yarn 15 having a flat cross-section, as can be seen, for example, in FIGS. 3, 5 and 7. The flat cross-section is characterized in that its width in a width direction B is greater than its height in height direction H at a right angle relative to the width direction B. In particular, the width may be greater by at least the factor 2 than the height H of the reinforcing yarn 15. In the exemplary embodiment, the cross-section is elliptical or oval.

In order to ensure optimal mechanical properties, a convolution of the reinforcing threads 13, 14 is to be avoided. For this purpose, the reinforcing warp threads 13 are arranged parallel in a first reinforcing layer. The reinforcing weft threads 14 extend at a right angle thereto and form a second reinforcing layer 17. In the plan view of the fabric 10 in FIG. 1, as well the first reinforcing layer 16 is positioned above the second reinforcing layer 17; however, this depends on the direction from which the fabric 10 is being viewed. The reinforcing warp threads 14 and the reinforcing weft threads 13 are superimposed without binding. They form a plurality of intersecting points 18 that are not bound. The reinforcing threads 13, 14 of the reinforcing system 11 extend at the smallest possible distance next to each other, so that a tightly woven fabric 10 is the result. It will be understood that the drawing is only a schematic illustration and not true to scale.

The reinforcing yarn 15 comprises carbon fibers, aramid fibers or glass fibers or is made of such fibers. Alternatively, the use of other reinforcing yarns 15 is also possible. For example, it is possible to embody the reinforcing yarn as a so-called roving, wherein a plurality of individual fibers are arranged parallel next to each other without being twisted and form the reinforcing yarn 15.

The reinforcing warp threads 13 and the reinforcing weft threads 14 extend stretched in their respective reinforcing layer 16 or 17. This is understood to mean that there will be no kinks or convolutions of the reinforcing threads 13, 14 in the fabric 10 caused by binding. Radii or curvatures of the reinforcing threads 13, 14 are formed only by shaping the fabric in the composite material or the composite material body while it is being draped. In this manner, it is possible to achieve optimal strength and stiffness.

The binding system 12 consists of binding warp threads 20 and binding weft threads 21. The binding warp threads extend parallel to each other and parallel to the reinforcing warp threads 13 in warp thread direction K. At a right angle thereto in the weft thread direction S, in which extend the reinforcing weft threads 14, the binding weft threads 21 extend. In the exemplary embodiment, the binding weft threads 21 extend adjacent the first reinforcing layer 16, while the binding warp threads 20 extend adjacent the second reinforcing layer 17. In this manner, the binding warp threads 20 and the binding weft threads 21 enclose the reinforcing system 11 sandwich-like. A binding of the fabric 10 is accomplished only by the binding system 12. To accomplish this, the binding warp threads 20 are woven to the binding weft threads 21 at the binding points 22. In the case of fabric 10, this is accomplished by a so-called leno weave, so that the binding system 12 could also be referred to as a leno system.

Figure 2:
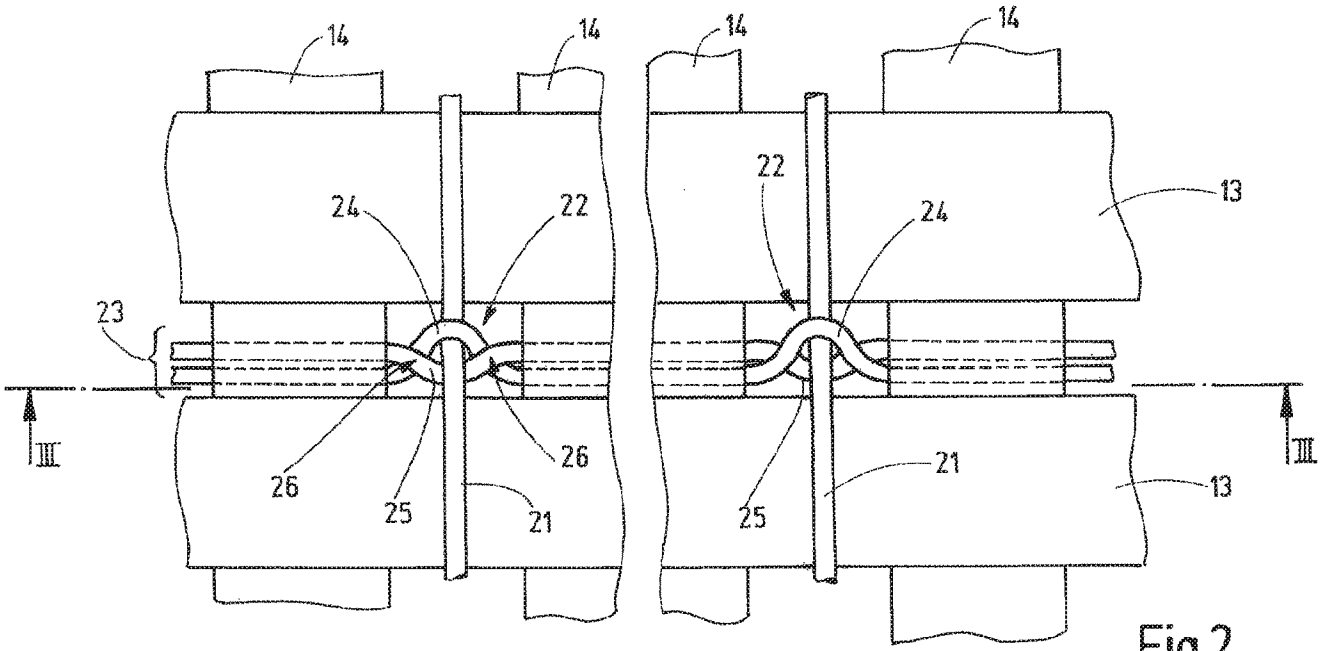
FIG. 2 is a schematic plan view of two successive binding points of the fabric, such as shown in FIG. 1, having a first binding type of binding system.
Figure 3:
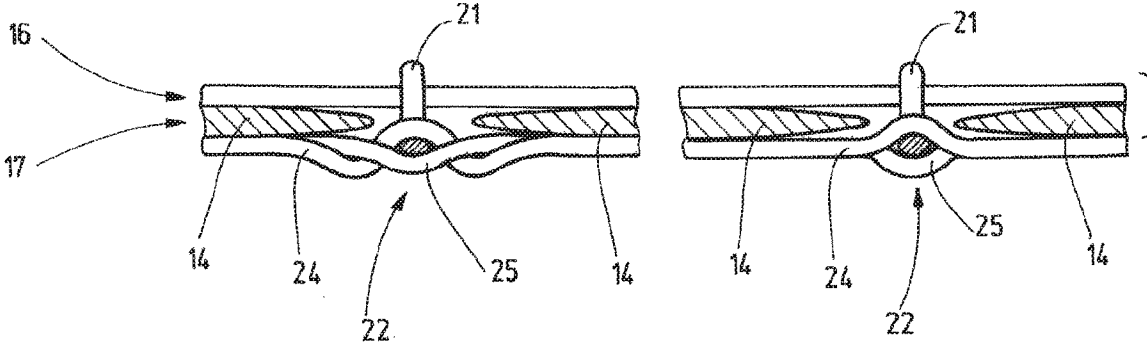
FIG. 3 is a vertical section of the illustrated fabric taken in the plane of line III-III in FIG. 2.
Figure 4:
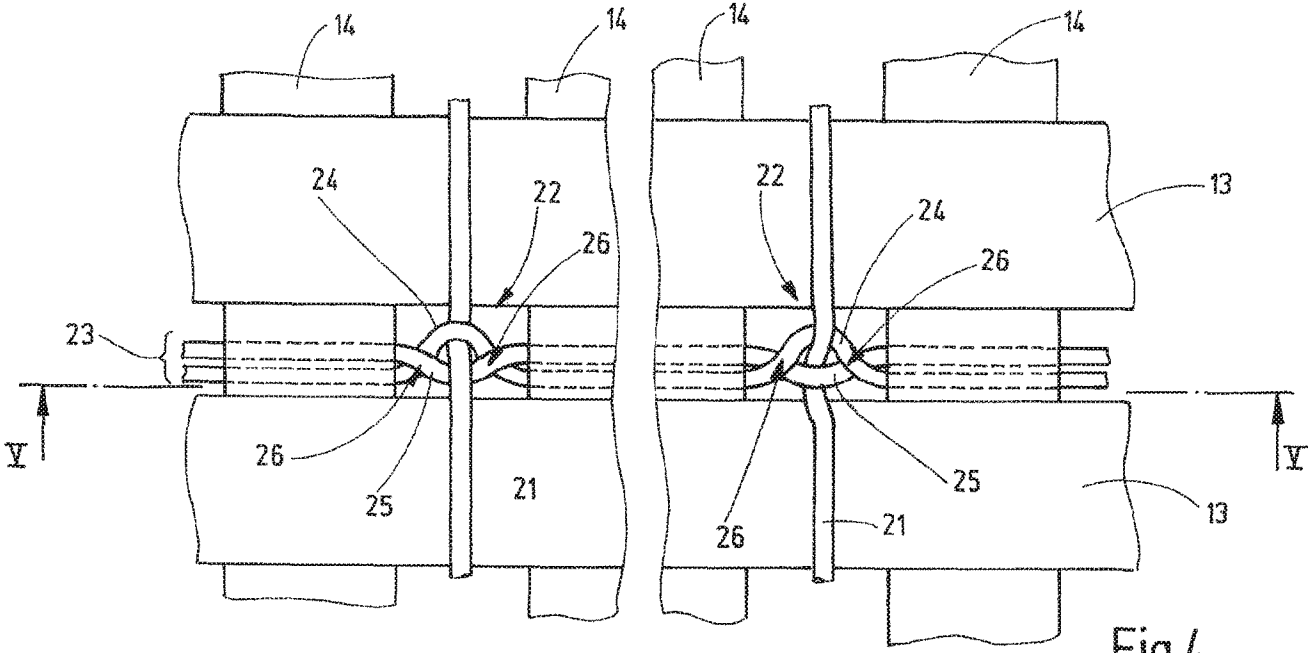
FIG. 4 is a schematic plan view of two successive binding points of the fabric, such as used in FIG. 1, with a second binding type of binding system.
Figure 5:
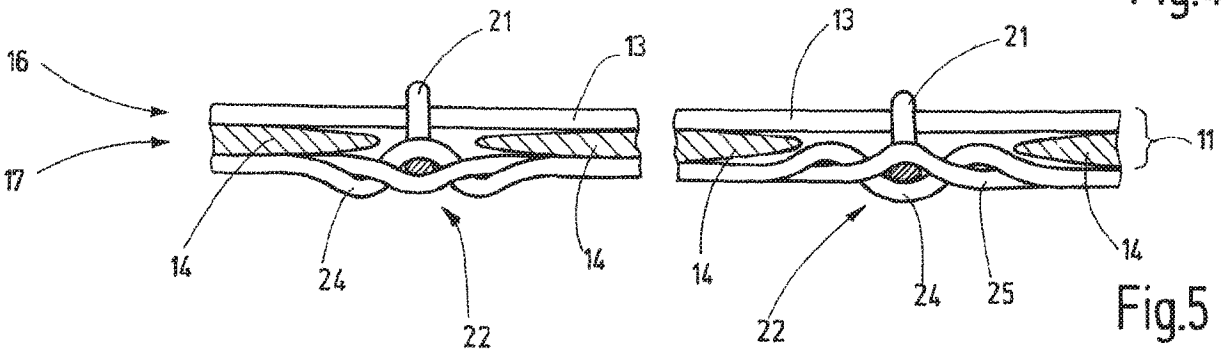
FIG. 5 is a vertical section of the illustrated fabric taken in the plane of line V-V in FIG. 4.

FIGS. 2 through 5 show more detailed illustrations of the weave at the binding points 22. FIGS. 2 and 3 show a half-leno weave, while FIGS. 4 and 5 show full leno weaves. The binding warp threads 20 are arranged in the form of warp thread pairs 23. In doing so, a binding warp thread 20 of a warp thread pair 23 represents a regular warp thread 24, while the respectively other binding warp thread 20 acts as the stationary warp thread 25. At the binding points 22, the binding weft thread 21 extends between the regular warp thread 24 and the stationary warp thread 25 of a warp thread pair 23 and is thus held in place. In this manner, a good fixation of the relative position of the threads 20, 21 in the binding system 12 is achieved, thus resulting in a great displacement resistance of the fabric 10. This displacement resistance can be produced without high thread tension in the binding system 12. Due to the only minimal thread tension, a convolution of the reinforcing warp threads 13 and the reinforcing weft threads 14 in the reinforcing system 11 is avoided. The elongated reinforcing threads 13, 14 guarantee the desired mechanical properties of the composite material.

The stationary warp threads 25 and the regular warp threads 24 of a warp thread pair 23 have intersecting points 26. In the exemplary embodiment, one or two intersecting points 26 are provided between each of the binding points 23. As is shown in FIGS. 2 through 5, in particular, the intersecting points 26 are located preferably directly in front of or behind a binding point 22. In other words, a respective intersecting point 26 of the binding warp threads 20 is arranged in the area between two reinforcing warp threads 13 and two reinforcing weft threads 14 where there is also a binding point 22. In this manner, the space required in any event for the binding point 22 between the reinforcing threads 13, 14 of the reinforcing system 12 is used for providing the intersecting points 26.

Referring to the half leno weave shown in FIGS. 2 and 3, the regular warp threads 24 extend—in viewing direction on the binding weft threads 21—at the binding points 22 above the respective binding weft thread 21. Correspondingly, the stationary warp thread 25 extends on the binding points 22 always on the other side underneath the binding weft thread 21. In the half leno weave, intersecting points 26 exist only at every second binding point 22 of a warp thread pair 23, i.e., preferably directly in front of and behind the binding point 22 of the respective binding weft thread 21.

Different therefrom, in the full leno weave as in FIGS. 4 and 5, the stationary warp thread 25 and the normal warp thread 24 extend alternately once above and once below the binding warp thread 21. In the full leno weave, each binding point 22 of a warp thread pair 23 has intersecting points 26, i.e., preferably in front of and behind the binding point 22 with the respective binding weft thread 21.

In any event, in all binding types, the binding warp thread 21 is received between the regular warp thread 24 and the stationary warp thread 25 and fixed in place at the binding point 22.

In the exemplary embodiment, the number of binding weft threads 21 is lower than the number of reinforcing threads 14. The number of binding points 22 in the binding system 12 is thus smaller than the number of intersecting points 18 in the reinforcing system 11. The number of binding warp thread pairs 20 is at most as great as the number of reinforcing warp threads 13, wherein the number is preferably smaller. The float in the binding system 12, i.e., the distance between the binding points 22, may remain constant or also vary within the fabric 10. Fabric areas that require a greater displacement resistance may have a greater number of binding points 22. Fabric areas that require a better shiftability of the reinforcing threads 13, 14 of the reinforcing system 11, e.g., to improve drapability, may display a greater distance between the binding points 22 and thus display a greater float. The float in the fabric 10 may vary in longitudinal direction of the fabric and/or in transverse direction of the fabric.

Figure 7:
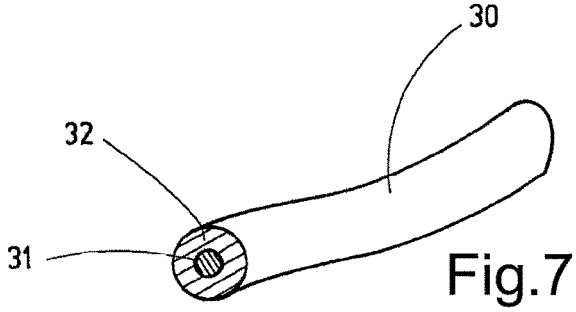
FIG. 7 is a perspective of the structure of a binding yarn, including core and coat, used in the illustrated fabric.

FIG. 7 shows the reinforcing yarn 15 and also, schematically, a binding yarn 30. In the exemplary embodiment, the binding yarn 30 has a circular cross-section. In accordance with the example, the cross-section in width direction B and/or in height direction H is smaller than the cross-section of the reinforcing yarn 15. Preferably, the titer of the binding yarn 30 is smaller than the titer of the reinforcing yarn 15. In the exemplary example, the titer of the binding yarn 30 is a maximum of 500 dtex.

Figure 6:
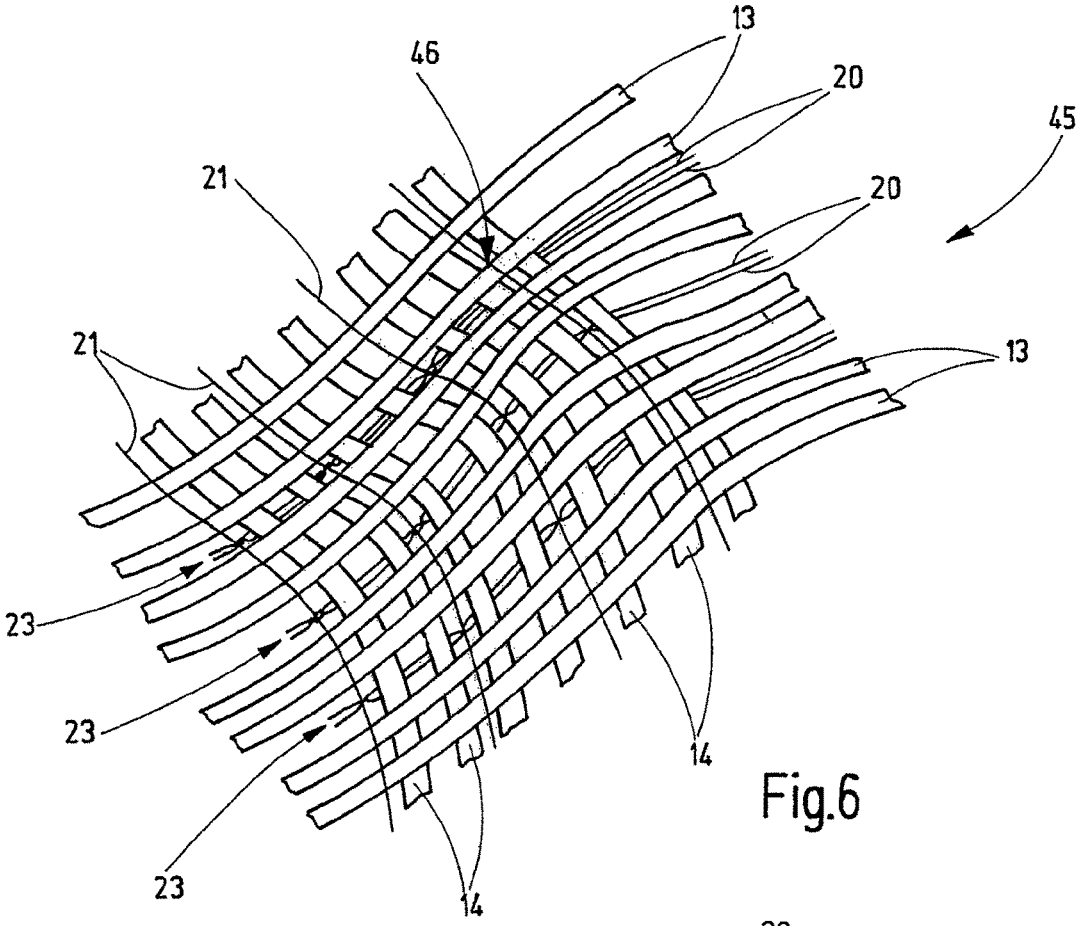
FIG. 6 is a perspective schematic of a fabric such as shown in FIG. 1, for the production of a preform.

In the preferred exemplary embodiment, a hot-melt adhesive yarn is used, said yarn, for example, consisting of copolyester or of Grilon MS® by EMS Chemie company. It is also possible to use other phenoxy yarns. The binding yarn 30 mentioned as the hot-melt adhesive yarn has a core 31 that is completely enclosed in circumferential direction by a coat 32. The core 31 and the coat 32 consist of different materials. In particular, the melting temperature of the coat 32 is lower than the melting temperature of the core 31. As a result of this, it is possible in the production of a composite material body to fix an appropriately shaped fabric 10 in place or combine it with other fabric layers, should this be desirable, for example in the manufacture of a preform. In this case, the hot-melt adhesive bonding with other material layers can be accomplished very simply by thermal action, without additional binders. At the same time, the binding yarn 30 remains stable because the core 31 does not melt due to its higher melting temperature. FIG. 6 shows schematically a shaping of a fabric section.

The fabric 10 is used for the production of a composite material body. If, as shown by FIG. 6, a fabric layer 45 is to be fixed in place beforehand and/or bound to additional fabric layers in the course of a manufacturing process and is to be fixed in place beforehand in a desired three-dimensional form, the fabric layer 45 or the superimposed fabric layers can be treated by thermal action within a melting region 46. Thus it is possible to produce a preform, for example. However, this fixation can also take place only during the subsequent shaping during the production of the composite material body. In doing so, the binding threads 20, 21 of the binding system 12 may also insert a hot-melt adhesive bond with the plastic material of the composite material body. In this manner, also a good interlaminar bond is achieved, thus ensuring a high interlaminar shearing strength of the composite material body.

Figure 8:
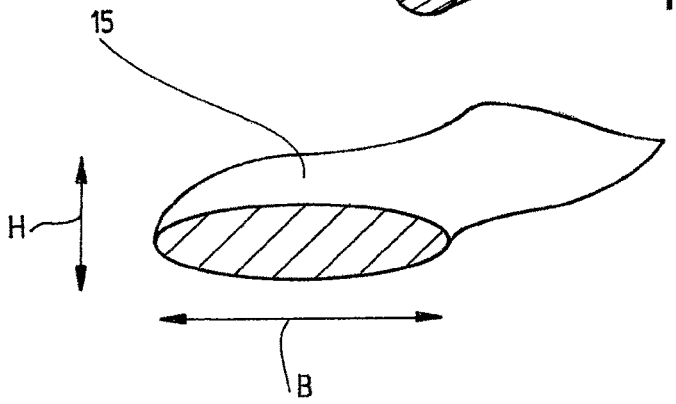
FIG. 8 is a perspective of a reinforcing yarn of the illustrated fabric.
Figure 9:
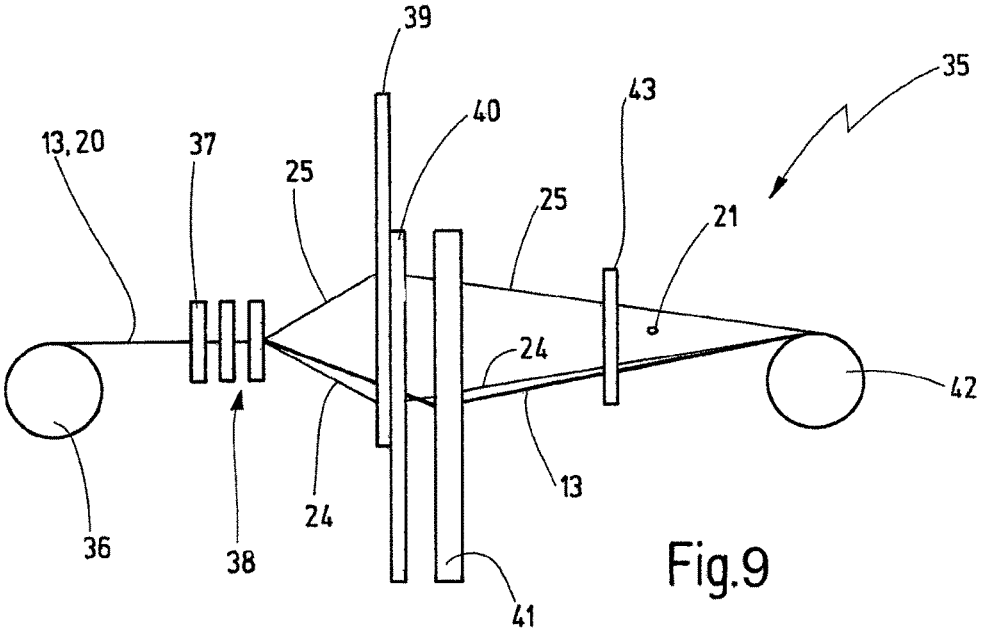
FIG. 9 is a schematic of a weaving machine during insertion of binding weft threads in the production of the illustrated fabric.
Figure 10:
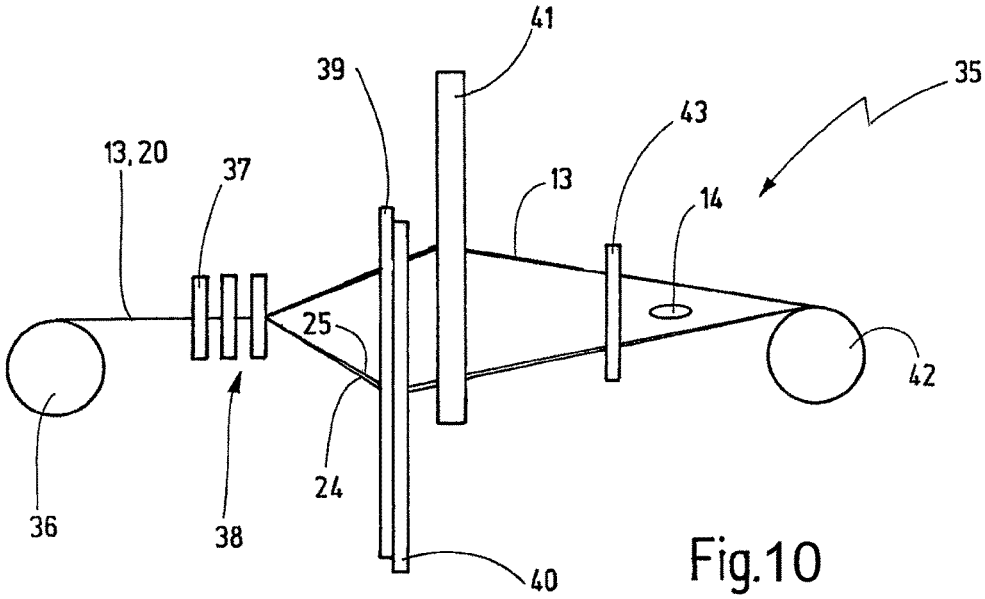
FIG. 10 is a schematic of the weaving machine shown in FIG. 8 during insertion of reinforcing weft threads in the production of the illustrated fabric.

FIGS. 8 and 9 schematically show a weaving machine 35 for the manufacture of a fabric 10. The weaving machine 35 comprises a back-rest 36 by means of which the warp threads 13, 20 can be fed. The warp threads 13, 20 then move through a warp stop motion 37 and through the drop wires 38. In continuation, the weaving shafts, each having a plurality of healds, are provided, said healds being disposed for shed formation. The stationary warp threads 25 are guided in a shared first weaving shaft 39. A second weaving shaft 40 guides the regular warp threads 24. A thread weaving shaft 41 guides the reinforcing warp threads 13. A reed 43 for the abutment of the warp threads 21 and 14, respectively, against the weaving edge is provided between the weaving shafts 39, 40, 41 and a fabric take-down 42.

The regular warp threads 24 are guided in a leno harness in the second weaving shaft 40. Such a system is described, for example, in publication EP 2 063 007 A1, to which reference is made to this extent. There, half-leno bindings are produced. As an alternative thereto, leno harnesses have also been known for the production of full leno weaves, which may be used alternatively. Preferably, special healds are provided in the third weaving shaft 41 for guiding the reinforcing warp threads 13, said healds being known, for example from publication EP 1 795 636 A1.

During the manufacture of the fabric 10 with the use of the weaving machine 35, the warp threads 13, 20 are fed via the back-rest 36. The reinforcing warp threads 14 and the binding weft threads 21 are inserted in a prespecified sequence. When a reinforcing weft thread 21 is inserted, the first weaving shaft 39 positions the stationary warp threads 25 in the upper shed. The regular warp threads 24, as well as the reinforcing warp threads 13, are positioned via the two weaving shafts 40, 41 in the lower shed. Depending on the leno weave, the intersecting points 26 are formed in the second weaving shaft 40 by means of the leno harness, as illustrated in FIGS. 2 through 5. During the insertion of a reinforcing weft thread 14, only the reinforcing warp threads 13 are in the upper shed. The binding warp threads 20, i.e., the regular warp threads 24 as well as the stationary warp threads 25, are in the lower shed. FIG. 8 shows the insertion of a binding weft thread 21, while FIG. 9 shows the insertion of the reinforcing weft thread 14.

Depending on the number of binding points 22 and their distance from each other, two or more reinforcing weft threads 14 are inserted after the insertion of a binding weft thread 21. The number of reinforcing weft threads 14 extending between two binding weft threads 21 may vary. Likewise, the number of reinforcing warp threads 13 between two warp thread pairs 23 of binding warp threads 12 may vary. For this purpose, the weaving machine 35 may also remove individual warp thread pairs 23 of binding warp threads 20 or individual reinforcing warp threads 13 from the weaving process. To do so, not specifically shown warp thread holders may be provided, these separating the warp threads 13, 20 that are to be taken out and holding them available in the region of the fabric edge before the fabric take-down 42. The warp thread holder is spatially movable for grasping and positioning the warp thread that is to be separated. The weaving machine 35 may also comprise several such warp thread holders. Furthermore, the weaving machine 35 may comprise an appropriate holding device, to which the warp thread holder feeds the separated and taken out warp thread, so that the holding device can hold the warp thread in a desired position ready for the later renewed supply.

From the foregoing it can be seen that a fabric 10 is provided for use in composite materials and composite material bodies. The fabric 10 has a reinforcing system 11 made of reinforcing warp threads 13 and reinforcing weft threads 14, which are placed on top of one other in two different reinforcing layers 16, 17, without binding, and represent a core so-to-speak. The reinforcing threads 13, 14 are formed from a reinforcing yarn 15. A binding system 12 of binding warp threads 20 and binding weft threads 21 is formed from a binding yarn 30 with a lower yarn count than the reinforcing yarn 15. The fabric is bound exclusively within the binding system 12. The reinforcing system 11 is enclosed between the binding warp threads 20 on the one side and the binding weft threads 21 on the other side, and thus held in place. Binding points 22 are provided in the binding system 12. At each binding point 22, a binding warp thread 20 is guided and held between a stationary warp thread 25 and a regular warp thread 24 of a warp thread pair 23 of binding warp threads 20. Between two adjacent binding points 22 of a warp thread pair 23, the stationary warp thread 25 and the regular warp thread 24 have at least one intersecting point 26. All warp threads 13, 20 run in one warp thread direction K substantially parallel to one another. All weft threads 14, 21 run in one weft thread direction S substantially parallel to one another and transverse to the warp thread direction K.

LIST OF REFERENCE SIGNS

10 Fabric
11 Reinforcing system
12 Binding system
13 Reinforcing warp threads
14 Reinforcing weft threads
15 Reinforcing yarn
16 First reinforcing layer
17 Second reinforcing layer
18 Intersecting points
20 Binding warp thread
21 Binding weft thread
22 Binding point
23 Warp thread pair
24 Regular warp thread
25 Stationary warp thread
26 Intersecting point
30 Binding yarn
31 Core
32 Coat
35 Weaving machine
36 Back-rest
37 Warp stop motion
38 Drop wires
39 First weaving shaft
40 Second weaving shaft
41 Third weaving shaft
42 Fabric take-down
43 Reed
45 Fabric layer
46 Melting region
B Width direction
H Height direction
K Warp thread direction
S Weft thread direction

The invention claimed is:

1. A fabric (10) for use in composite materials, comprising a reinforcing system (11) of reinforcing warp threads (13) and reinforcing weft threads (14), said reinforcing warp threads (13) forming a first reinforcing layer (16), said reinforcing weft threads (14) being placed on said first reinforcing layer (16) of said reinforcing warp threads (13) without binding with the reinforcing warp threads (13) for forming a second reinforcing layer (17);

a binding system (12) of binding warp threads (20) and binding weft threads (21), said reinforcing system (11) being located between the binding weft threads (21) and the binding warp threads (20), pairs of said binding warp threads (20) each comprising a stationary warp thread (25) and a directly adjacent regular warp thread (24) which cross each other multiple times with said binding warp threads (20) being woven to a binding weft thread (21) by a leno weave at binding points (22) between the stationary warp thread (25) and a regular warp (24) of each pair for securing together the first and second reinforcing layers (16, 17) without a weaving connection between the threads of the reinforcing system (11) and binding system (12).

2. The fabric (10) of claim 1 in which intersecting points (26) between crossing stationary warp threads (25) and regular warp threads (24) are located at the binding points (22) with the weft thread (21).

3. The fabric (10) of claim 1 in which reinforcing warp threads (13) cross the reinforcing weft threads (14) at intersecting points (18), and the number of intersecting points of the reinforcing warp threads (13) with the reinforcing weft threads (14) of the reinforcing system (11) is equal to or greater than the number of binding points (22) of the binding system (12).

4. The fabric (10) of claim 1 in which said reinforcing system (11) is made of a reinforcing yarn (15) comprising said reinforcing warp and weft threads (13, 14) and said binding system is made of a binding yarn (30) different from said reinforcing yarn (15) comprising said binding warp and weft threads (20, 21), said binding yarn (30) having a smaller cross-section than the reinforcing yarn (15).

5. The fabric (10) of claim 1 in which said reinforcing system (11) is made up of reinforcing yarn (15) comprising said reinforcing warp and weft threads (13, 14) and said binding system is made up of binding yarn (30) different from said reinforcing yarns (15) comprising said binding warp and weft threads (20, 21), and said binding yarn (30) has a lower titer than the reinforcing yarn (15).

6. The fabric (10) of claim 4 in which said reinforcing yarn (15) comprises at least one of carbon, aramid, or glass fibers.

7. The fabric (10) of claim 4 in which said reinforcing yarn (15) has a flat cross-section with a dimension in one direction (B) greater than the dimension at a right angle thereto.

8. The fabric (10) of claim 4 in which said binding yarn (30) is made of a material that will bind with a plastic material of a composite material during the production of a composite material.

9. The fabric (10) of claim 4 in which the material and titer of the binding yarn (30) are such that an interlaminary shearing strength of a composite material produced therefrom deviates from a nominal value prespecified by the reinforcing system (11) by a maximum of one prespecified tolerance value.

10. The fabric (10) of claim 4 in which the binding yarn (30) contains plastic material.

11. The fabric (10) of claim 4 in which the binding yarn (30) contains a phenoxy plastic material.

12. The fabric (10) of claim 4 in which the binding yarn (30) comprises a core (31) and a coat (32) enclosing the core (31), said core (31) having a higher melting temperature than said coat (32).

13. A method for producing the fabric (10) of claim 1, comprising the steps of:

loading a weaving machine (35) with reinforcing warp threads (13), binding warp threads (20), reinforcing weft threads (14), and binding weft threads (21), inserting the reinforcing weft threads (14) and the binding weft threads (21) in a prespecified sequence, during insertion of the reinforcing weft threads (14) maintaining the reinforcing warp threads (13) in a same upper shed or lower shed, and during insertion of binding weft threads (21), for each pair binding warp threads (20), a binding warp thread (20) acting as a regular warp thread (24) is maintained in the same upper or lower shed while a binding warp thread (20) acting as a stationary warp thread (25) of each pair, as well as the reinforcing warp threads (13), are maintained in the other shed, and intersecting the regular warp thread (24) with the stationary warp thread (25) of each pair between the weft insertions with the binding weft thread (21) for forming (1) a reinforcing system (11) of reinforcing weft threads (14) and reinforcing warp threads (13) wherein the reinforcing warp threads (13) form a first reinforcing layer (16), the reinforcing weft threads (14) being placed on said reinforcing layer without binding with the reinforcing warp threads (13) for forming a second reinforcing layer (17), and (2) a binding system (12) of binding weft threads (21) and binding warp threads (20) woven together by a leno weave at binding points (22) for securing together the first and second reinforcing layers (16, 17) without a weaving connection between the threads of the reinforcing system (11) and binding system (12).

14. The method of claim 13 including guiding the reinforcing warp threads (13) in a single shared weaving shaft (41) of the weaving machine (35), and guiding the stationary warp threads (25) and the regular warp threads (24) in different weaving shafts (39, 40) of the waving machine (35).

15. The method of claim 14 including adapting the fabric (10) to the desired shape of a composite material body to be produced by melting the threads (20, 21) of the binding system (12) by thermal action in at least one melting region (46).

* * * * *